US009534864B2

(12) United States Patent
Dey

(10) Patent No.: US 9,534,864 B2
(45) Date of Patent: Jan. 3, 2017

(54) GAS COMPENSATED RECOILLESS LIQUID DISRUPTER

(71) Applicant: PROPARMS LTD., Carignan, Quebec (CA)

(72) Inventor: Rudra Kinkar Dey, Verdun (CA)

(73) Assignee: PROPARMS LTD., Carignan, Quebec (CA)

( * ) Notice: Subject to any disclaimer, the term of this patent is extended or adjusted under 35 U.S.C. 154(b) by 0 days.

(21) Appl. No.: 14/831,953

(22) Filed: Aug. 21, 2015

(65) Prior Publication Data

US 2016/0169614 A1 Jun. 16, 2016

Related U.S. Application Data

(60) Provisional application No. 62/092,286, filed on Dec. 16, 2014.

(51) Int. Cl.
*F41B 9/00* (2006.01)
*F41A 1/10* (2006.01)

(52) U.S. Cl.
CPC ..... *F41B 9/0046* (2013.01); *F41A 1/10* (2013.01)

(58) Field of Classification Search
CPC ..... F41B 9/0046; F41A 1/10; F41A 1/08
USPC ..... 86/50; 89/1.13, 1.7, 1.701
See application file for complete search history.

(56) References Cited

U.S. PATENT DOCUMENTS 3,771,417 A 11/1973 Schnabele et al.
3,779,130 A 12/1973 Schnabele
4,050,351 A 9/1977 Stauff
4,244,293 A 1/1981 Grosswendt et al.
4,478,128 A 10/1984 Black et al.
5,105,715 A 4/1992 Nordmann et al.
5,285,713 A 2/1994 Brage
5,337,648 A 8/1994 Brage
5,515,767 A 5/1996 Gilbert
5,743,246 A 4/1998 Mattern
5,841,056 A 11/1998 Long et al.
(Continued)

FOREIGN PATENT DOCUMENTS

CH 309598 A 9/1955
EP 0178039 A2 4/1986
(Continued)

*Primary Examiner* — Reginald Tillman, Jr.

(74) *Attorney, Agent, or Firm* — Fraser Clemens Martin & Miller LLC; James D. Miller

(57) ABSTRACT

The method of controlling recoil in a disrupter comprises: providing liquid in a liquid chamber of the disrupter, the liquid chamber having a front nozzle for expelling the liquid therethrough; providing combustible propellant in a propellant chamber of the disrupter that communicates with the liquid chamber and that has a rear nozzle for expelling combustion gases therethrough; providing a bather between the liquid and the propellant to avoid admixing both; and igniting the propellant to generate expanding combustion gases that will expel the liquid out of the disrupter through the front nozzle in a first direction, either rupturing or propelling the barrier in the process, the combustion gases exhausting out of the disrupter at least partly through the rear nozzle in a second direction, with the first and second directions being at least partly opposite one another to control the recoil of the disrupter.

6 Claims, 6 Drawing Sheets

(56) References Cited

U.S. PATENT DOCUMENTS

| | | | | |
|---|---|---|---|---|
| 5,966,858 | A | 10/1999 | Curtis et al. | |
| 6,116,136 | A | 9/2000 | Kirschner et al. | |
| 6,269,725 | B1 | 8/2001 | Cherry | |
| 6,408,731 | B1 | 6/2002 | Elsener | |
| 6,460,446 | B1 | 10/2002 | Kathe | |
| 6,964,220 | B1 | 11/2005 | Lavin | |
| 7,997,179 | B1 * | 8/2011 | Nelson | F41A 11/02 181/110 |
| 8,322,264 | B1 | 12/2012 | Van De Wal | |
| 8,448,556 | B2 | 5/2013 | Regebro | |
| 2005/0284649 | A1 | 12/2005 | Sabates et al. | |
| 2009/0031912 | A1 | 2/2009 | Gilbert | |

FOREIGN PATENT DOCUMENTS

| | | | |
|---|---|---|---|
| GB | 2083894 | A | 3/1982 |
| GB | 2291958 | A | 2/1996 |
| GB | 2299156 | A | 9/1996 |
| WO | 9205396 | A1 | 4/1992 |
| WO | 9514207 | A1 | 5/1995 |

* cited by examiner

GAS COMPENSATED RECOILLESS LIQUID DISRUPTER

CROSS-REFERENCE DATA

The present application claims conventional priority of provisional patent applicant No. 62/092,286 dated Dec. 16, 2014.

FIELD OF THE INVENTION

The present invention relates to a method of controlling recoil in a disrupter, and more particularly to a method that expels combustion gases and disrupting water in opposite directions to avoid recoil in the disrupter.

BACKGROUND OF THE INVENTION

It is known to control the recoil in a disrupter by using opposite jets of water being expelled through respective front and rear nozzles. The water to be expelled out through the front and rear nozzles is provided in respective chambers that will be both affected by a combusting propellant that is ignited within the disrupter.

It is not known to control the recoil in disrupters with the gases of the combusting propellant themselves.

SUMMARY OF THE INVENTION

The present invention relates to a method of controlling recoil in a disrupter, comprising:

- providing liquid in a liquid chamber of the disrupter, said liquid chamber having a front nozzle for expelling the liquid therethrough;
- providing combustible propellant in a propellant chamber of the disrupter that communicates with the liquid chamber and that has a rear nozzle for expelling combustion gases therethrough;
- providing a barrier between the liquid and the propellant to avoid admixing both;
- igniting the propellant to generate expanding combustion gases that will expel the liquid out of the disrupter through said front nozzle in a first direction, either rupturing or propelling the barrier in the process, the combustion gases exhausting out of the disrupter at least partly through said rear nozzle in a second direction, with the first and second directions being at least partly opposite one another to control the recoil of the disrupter.

In one embodiment, said barrier is a piston that will be propelled by the combustion gases through said liquid chamber to expel both the liquid and the piston out of said liquid chamber through said front nozzle.

In one embodiment, said front and rear nozzles are provided with respective front and rear frangible seals that will rupture upon a threshold pressure value being attained to respectively allow the liquid and the combustion gases to be expelled through said front and rear nozzles.

In one embodiment, the respective intrinsic resistances of said front and rear frangible seals are balanced with the respective expected pressures from the liquid and combustion gases after the propellant is ignited to allow the front frangible seal to rupture slightly before the rear frangible seal.

In one embodiment, the front nozzle has an inner diameter equal to that of said liquid chamber.

In one embodiment, the inner diameter of said front nozzle converges in a direction away from said propellant chamber.

In one embodiment, the disrupter is comprises of an elongated barrel having coextensive and aligned propellant and liquid chambers.

In one embodiment, the liquid is water.

DETAILED DESCRIPTION OF THE EMBODIMENTS

The invention provides a new method of controlling recoil in a disrupter comprising the steps of first providing liquid in a liquid chamber of the disrupter, the liquid chamber having a front nozzle for expelling the liquid therethrough; and providing combustible propellant in a propellant chamber of the disrupter that communicates with the liquid chamber and that has a rear nozzle for expelling combustion gases therethrough.

In one embodiment, the disrupter comprises an elongated barrel having coextensive and aligned propellant and liquid chambers.

The method further comprises providing a barrier between the liquid and the propellant to avoid admixing both. This barrier can be part of a cartridge that holds the propellant, and may further comprise a piston for pushing the liquid out of the liquid chamber.

The method also comprises igniting the propellant to generate expanding combustion gases that will expel the liquid out of the disrupter through the front nozzle in a first direction, either rupturing or propelling the barrier in the process, the combustion gases exhausting out of the disrupter at least partly through the rear nozzle in a second direction, with the first and second directions being at least partly opposite one another to control the recoil of the disrupter. This step is key to the present invention, in that the combustion gases will counterbalance the liquid as both are propelled in opposite directions.

According with one embodiment of the present invention, the front and rear nozzles are provided with respective front and rear frangible seals that will rupture upon a threshold pressure value being attained to respectively allow the liquid and the combustion gases to be expelled through the front and rear nozzles. The respective intrinsic resistances of the front and rear frangible seals are balanced with the respective expected pressures from the liquid and combustion gases after the propellant is ignited to allow the front frangible seal to rupture slightly before the rear frangible seal. Although this offset timing may suggest that the disrupter would move as a result of the propelled gases and liquid, as long as the rupturing of the front frangible seal occurs only a very short time period before that of the rear frangible seal, the inertia of the disrupter itself will prevent it from moving before the propulsion from the rearwardly expelled gases kick in.

Figure 8:
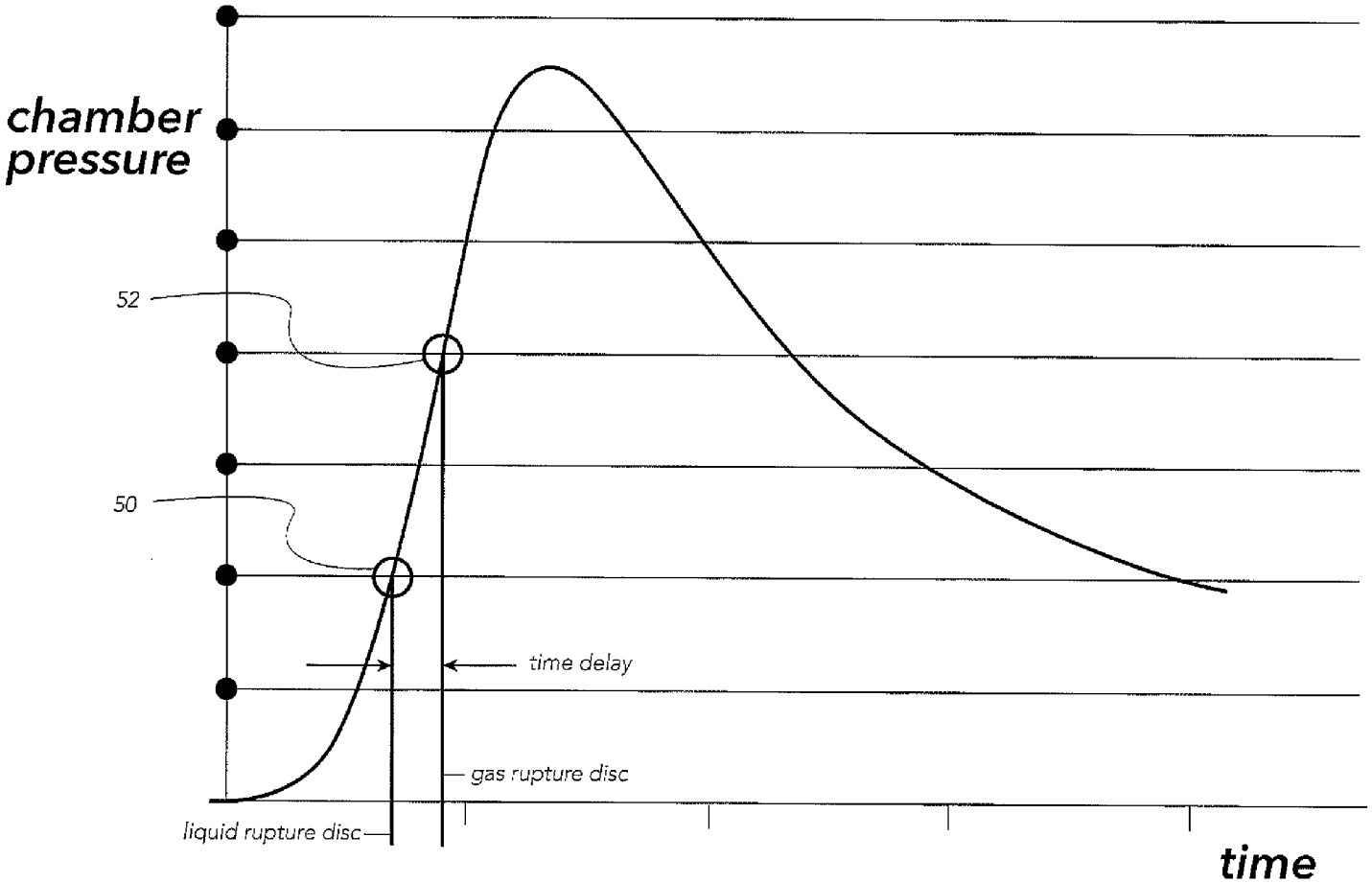
FIG. 8 is a graph showing the evolution of the pressure in the disrupter's housing inner chamber over time.
Figure 9:
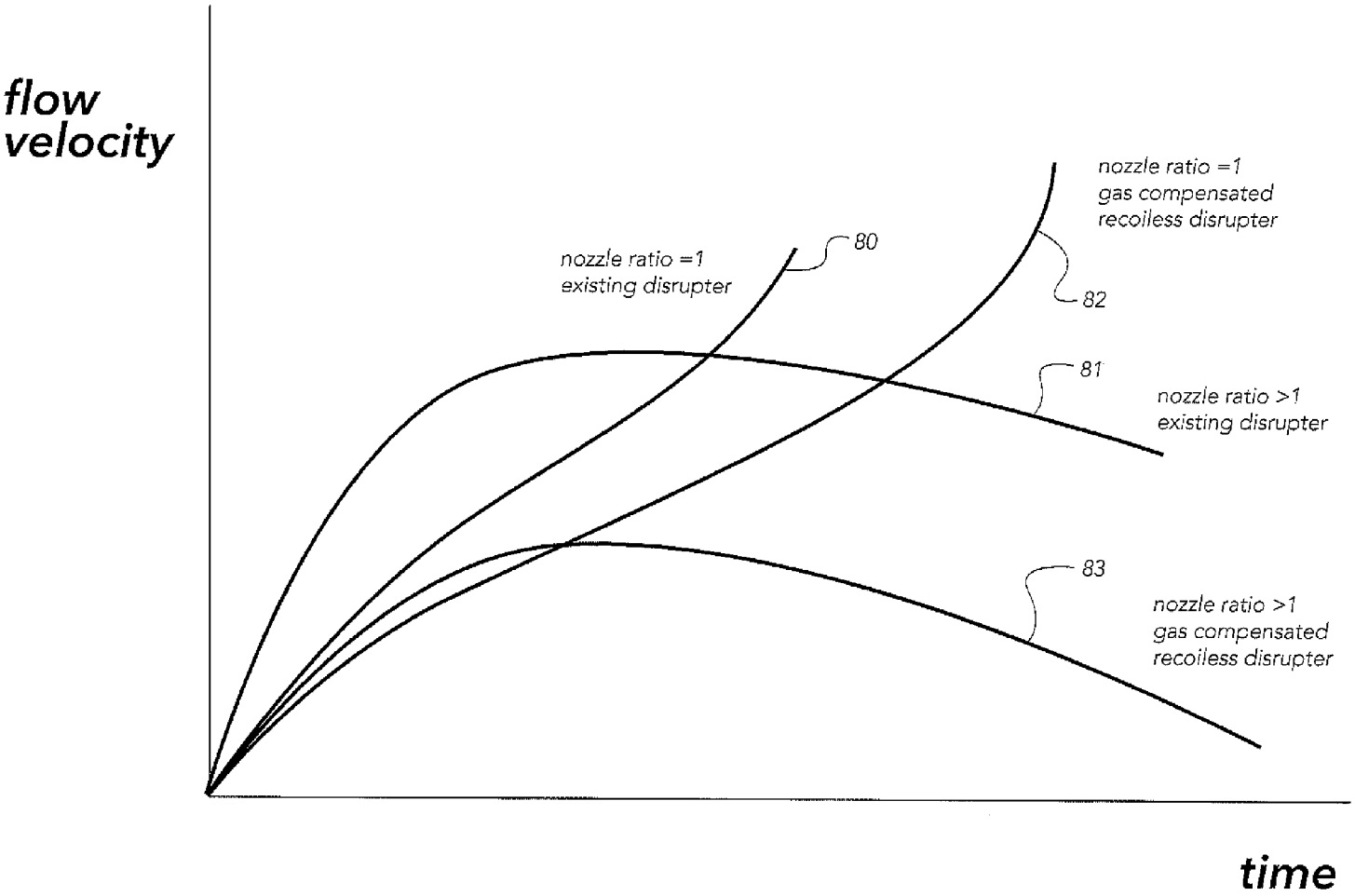
FIG. 9 is a graph showing the evolution of water flow velocity out of various disrupters over time at given respective water and propellant masses, more particularly showing curves for a representative existing prior art disrupter and for the disrupter of the present invention each equipped with front nozzles having different front nozzle ratios.
Figure 10:
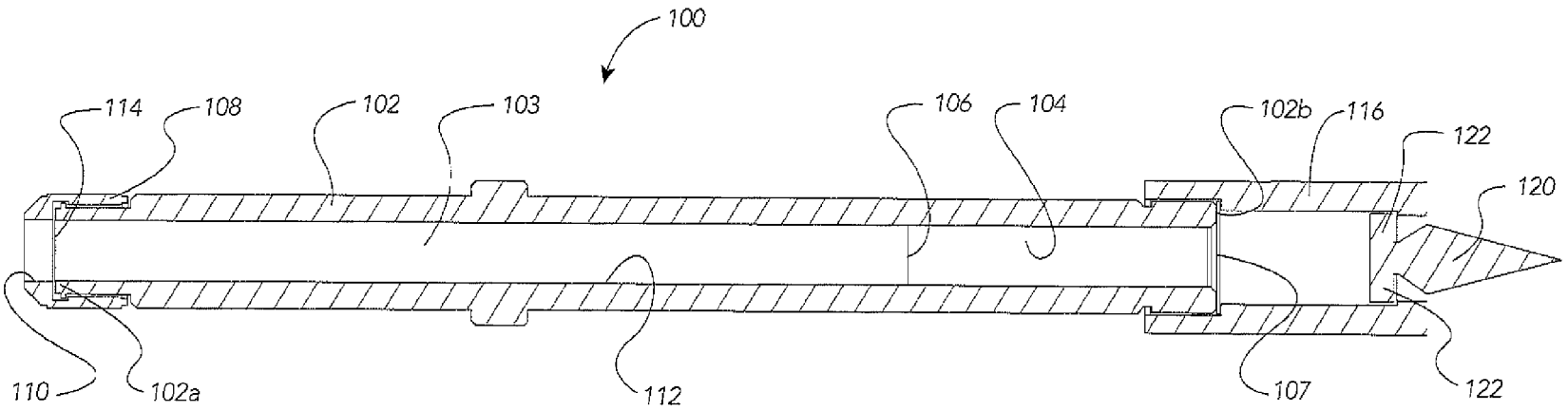
FIG. 10 is a cross-sectional elevation of a disrupter according to an alternate embodiment of the present invention.

FIGS. 1-7 show one embodiment of a disrupter used for enabling the method according to the present invention. FIGS. 8-9 show graphics that pertain to the disrupter of FIGS. 1-7. FIG. 10 shows an alternate embodiment of a disrupter according to the invention.

Regarding the embodiment shown in FIGS. 1-7 and further expressed through the graphics of FIGS. 8-9, FIGS. 1-4 particularly show a gas compensated recoilless liquid disrupter 10 according to the present invention. Disrupter 11 defines a front end 11*a* and a rear end 11*b* and comprises a generally cylindrical main body 12. Main body 12 in turn has front and rear body portions 14, 16 that are screwed to each other at threads 18 to allow both portions to be releasably fixed to each other. When front and rear body portions 14, 16 are screwed to each other, a fluid tight seal is formed at threads 18.

Front body portion 14 comprises a barrel 20 having a cylindrical inner channel 22. A front nozzle 24 is screwed at threads 26 to barrel 20. Nozzle 24 has a convergent inner channel 28: the inner diameter of nozzle channel 28 is larger near barrel 20—where it is equal to the diameter of barrel channel 22—than at disrupter front end 11*a* at the nozzle outlet orifice 49. It is noted however, as detailed hereinafter, that the nozzle outlet orifice 49 could alternately have the same diameter as that of barrel inner channel 22 throughout.

Rear body portion 16 comprises a propellant housing 30 defining a cylindrical inner chamber 32. A rear nozzle 34 is integrally formed with propellant housing 30 and extends rearwardly therefrom. Rear nozzle 34 has an inner channel 36 of the convergent-divergent type. More particularly, the rear nozzle channel 36 has a convergent portion 36*a* and a divergent portion 36*b* that define a throat 38 at their junction. Convergent portion 36*a* has a larger diameter at its junction with propellant housing inner chamber 32 and a smaller diameter at throat 38; and divergent portion has a smaller diameter at throat 38 and a larger diameter at disrupter rear end 11*b*.

In use, disrupter 11 needs to be filled with suitable liquid, e.g. water, and suitable ignitable propellant, e.g. smokeless powder, for it to operate. More particularly, propellant housing inner chamber 32 is filled with propellant between a piston 42 and a frangible rear rupture disc 44. To do this, rear body portion 16 is first removed from front body portion 14. A propellant cartridge 45 is then inserted into housing inner chamber 32. Cartridge 45 has a peripheral wall 47 that has approximately the same diameter as the housing inner chamber 32 to snugly fit therein; a rear rupture disc 44 at one end that is fixedly attached to peripheral wall 47; and a piston 42 at the other end that is tightly fitted within a peripheral wall front opening. Cartridge 45 is inserted in housing inner chamber 32 to have rear rupture disc 44 rest against the shoulder formed by the converging portion 36*a* of rear nozzle inner channel 36. Rear rupture disc 44 is provided with an igniter 46 that projects within cartridge 45 where the propellant is contained. A wire 48 is operatively connected to igniter 46 and extends through rupture disc 44. Wire 48 extends out of disrupter 11 through rear nozzle 34 to allow igniter 46 to be remotely triggered. It is understood that alternate wireless means of remotely triggering igniter 46 could also be envisioned instead of using wire 48.

Figure 1:
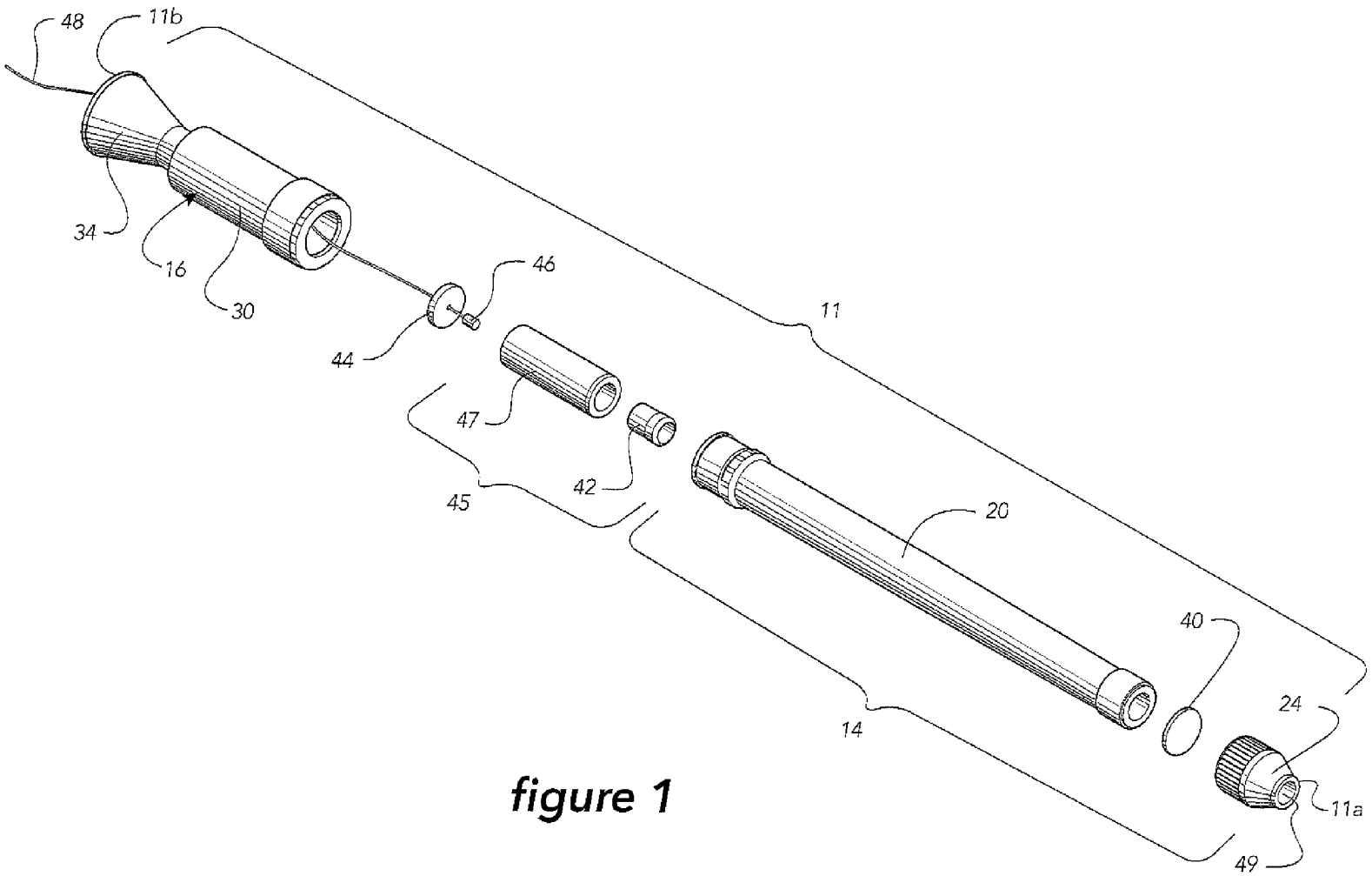
FIG. 1 is an exploded perspective view of a disrupter according to one embodiment of the present invention.
Figure 2:
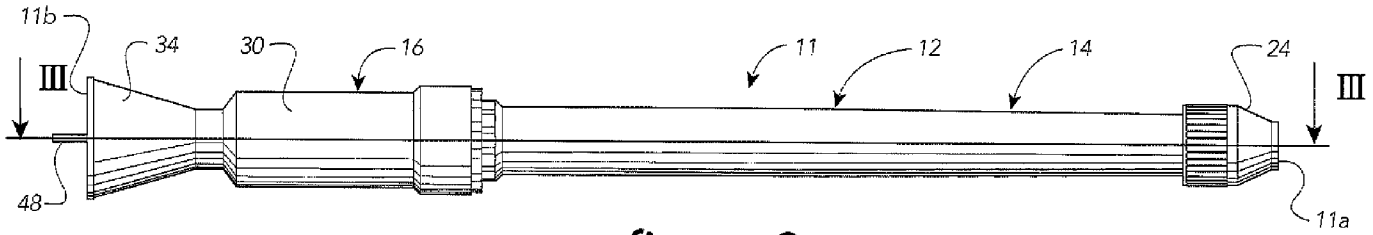
FIGS. 2 and 3 are respectively a side elevation and a cross-sectional elevation of the disrupter of FIG. 1.
Figure 3:
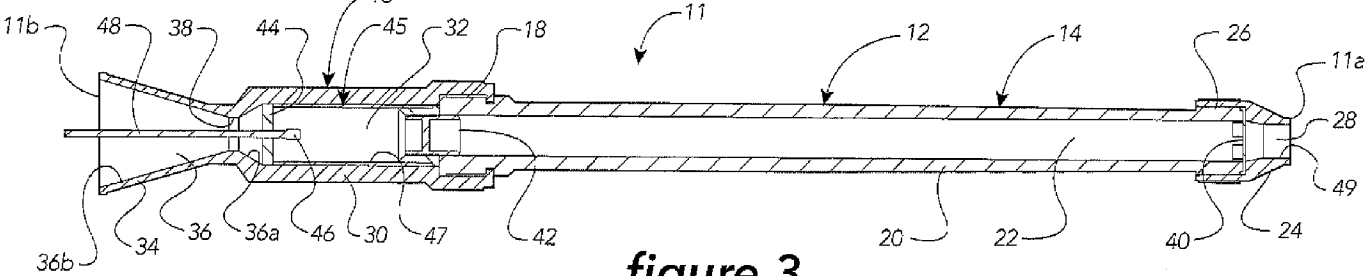
Figure 4:
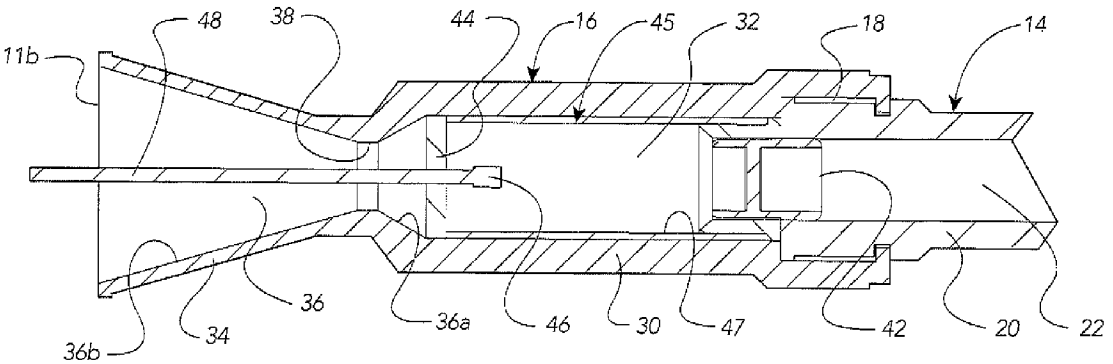
FIG. 4 is an enlarged cross-sectional elevation of the rear portion of the disrupter of FIG. 1.
Figure 7:
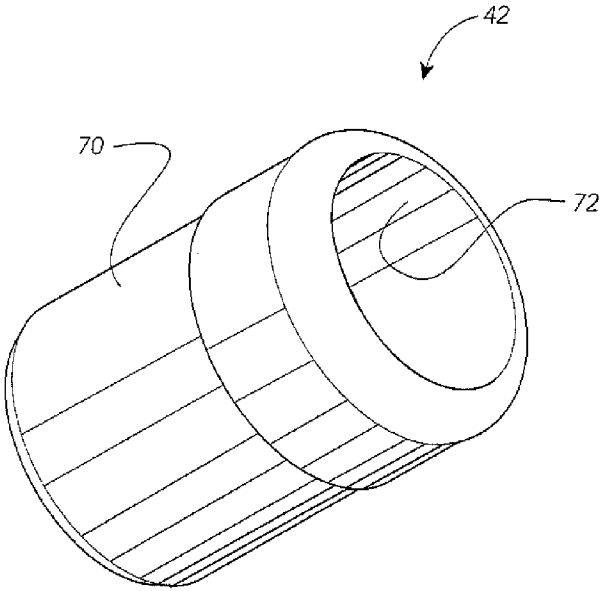
FIGS. 5, 6 and 7 are respectively a side elevation, a cross-sectional elevation and a perspective view of the piston of the disrupter of FIG. 1.
Figure 5:
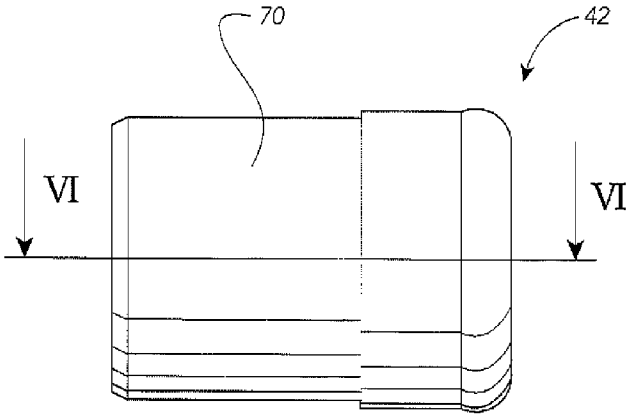
Figure 6:
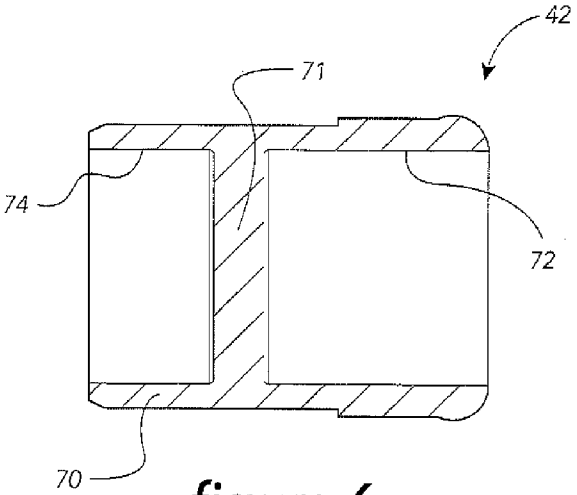

Piston 42 is additionally shown in FIGS. 5, 6 and 7. It comprises a cylindrical main body 70, an intermediate wall 71 extending within main body 70 and front and rear concave openings 72, 74 on either side of intermediate wall 71.

Once cartridge 45 is fitted inside housing 30, front body portion 14 is screwed onto rear body portion 16. Piston 42 forms a fluid-tight seal within disrupter main body 12 that allows the barrel inner chamber 22 to be filled with water without water seeping into cartridge 45 or out through the rear end 11*b* of disrupter 11. To fill barrel inner chamber 22 with water, disrupter 11 will be positioned upright, with its front end 11*a* facing upwardly. Water (or other suitable liquid) is poured into barrel 20. A frangible front rupture disc 40 is then installed at the front end of barrel 20 before front nozzle 24 is threaded onto the front end of barrel 20 to fix front rupture disc 40 in place.

Disrupter 11 can then be positioned at a desired location for use in disrupting a bomb or other device. More particularly, disrupter 11 will be installed, as known in the art, with its front end 11*a* pointing towards the area of the device that is to be targeted for disruption. Once disrupter 11 is thusly installed, everyone may evacuate the immediate vicinity of the device to be disrupted before igniter 46 is remotely triggered which will yield combustion of the propellant in housing inner chamber 32.

As a result of the combustion of the propellant, the pressure within housing inner chamber 32 will increase significantly in a relatively short period of time. Reference is made to FIG. 8 wherein the pressure within housing inner chamber 32 is shown as it evolves over time, starting at the time of the ignition. As suggested from this graph, the pressure in housing inner chamber 32 will gradually increase to apply pressure front rupture disc 40 transmitted by piston 42 and the liquid in liquid chamber 22. The pressure in chamber 32 will thusly increase until it reaches a point where it is sufficient to rupture the front rupture disc 40 (shown at point 50 in FIG. 8). The intrinsic resistance of front rupture disc 40 is what prevents this rupturing from occurring earlier.

Once front rupture disc 40 ruptures, the water starts to evacuate from barrel 20 which allows piston 42 to move forward within barrel inner chamber 22. Water starts to be expelled from disrupter 11 at this point. The pressure within housing inner chamber 32 will continue to increase until a second threshold is reached (shown at point 52 in FIG. 8) at which point the rear rupture disc 44 will rupture. The intrinsic resistance of rear rupture disc 44 is what prevents this rupturing from occurring earlier. The time delay between the rupturing of the front and rear rupture discs 40, 44 is very short, but existent. The combusting propellant is exhausted through rear nozzle 34 after rear rupture disc 44 ruptures, although a minor proportion of gases may be expelled through front nozzle 24 when all liquid has been expelled.

Piston 42 will be propelled by the combustion gas until it is literally expelled out of the disrupter's front end 11*a*. More particularly, the important pressure in barrel 22 will force piston 42 to deform and squeeze through the outlet orifice 49 of front nozzle 24 even if the diameter of orifice 49 is smaller than that of barrel inner chamber 22. To this end, piston 42 is consequently made from a semi rigid material capable of deforming under the disrupter's operating pressure range.

The fluid-tight seal between piston 42 and barrel 20 is maintained even during the combustion stage, i.e. the combustion gas doesn't mix with the water within disrupter 11.

As piston 42 moves forward within the barrel's inner channel 22, the entire water within barrel 20 will be expelled at high velocity through outlet orifice of front nozzle 24. This jet of water will be capable of piercing solid material to disrupt the explosive device targeted by disrupter 11.

The front rupture disc 40 is necessary not only to prevent the water to escape barrel 20 while disrupter 11 is being manipulated prior to it being triggered, but also to allow a sufficient pressure buildup in housing inner chamber 32 after the propellant is ignited but before the water is expelled, so that the water will be expelled with sufficient velocity at the outset to pierce through the potentially highly resistant casing of the explosive device.

The rear rupture disc 44 is necessary not only to prevent the granular propellant to escape housing inner chamber 32 while disrupter 11 is being manipulated prior to it being triggered, but also to allow sufficient pressure buildup in housing inner chamber 32 after the propellant is ignited but before the combustion gas is expelled. This allows the disrupter to achieve a pressure equal to or greater than the operating pressure of the rear convergent-divergent nozzle 34, which accelerates the gases in a much more efficient manner.

As will be noted from the above, disrupter 11 comprises a certain number of elements that are intended to be reusable: these include all elements forming the disrupter's main body 12, namely front nozzle 24, barrel 20 and rear body portion 16. That is to say that those elements of disrupter 11 will be used over and over again. The other elements are single-use elements that will need to be replaced every time disrupter 11 is operated: front rupture disc 40, cartridge 45, wire 48 and, of course, water and propellant.

The present invention provides a disrupter 11 that can be calibrated to control or even to cancel all recoil to avoid the disrupter 11 being propelled rearwards under the front water jet being expelled. This is achieved by the frontward thrust of the combustion gas created by the combusting propellant being exhausted through the rear nozzle 34 that will counteract the rearwards thrust of the water jet being expelled through the front nozzle 24.

More particularly, to achieve recoilless operation of disrupter 11, the thrust by the water jet over time must be balanced with the thrust of the exhausted combustion gas over time:

$$F_{water}*\Delta t_{water}=F_{combusition\ gas}*\Delta t_{combustion\ gas}$$

Parameters to control to obtain recoilless operation are the respective masses of water and combustion gas, together with the time it takes to expel both of them respectively through front and rear nozzles 24, 34. The mass of combustion gas being expelled is related to the type of propellant being used. The type of propellant being used will also determine the energy generated by the combustion of said propellant, and will affect the pressure within the disrupter 11. Different types of propellant may be used, and careful calibration must be effected to arrive at a suitable momentum balance to obtain a recoilless disrupter.

As mentioned above and as shown in FIG. 8, the respective intrinsic resistances of the front and rear rupture discs 40, 44 are balanced to allow rear rupture disc 44 to rupture slightly after front rupture disc 40. Although this might suggest that there would exist some rearward recoil in the time interval between the rupturing of the front rupture disc 40 and that of the rear rupture disc 44, in practice there is no recoil. The reason for this is that the time interval is very small and the inertia of the disrupter itself will prevent recoil movement from occurring during that small time interval. After the rupturing of the rear rupture disc 44, the exhausting combustion gas counteracts the frontward water jet to control or avoid recoil.

One reason why the front rupture disc 40 is calibrated to rupture before the rear rupture disc 44 is to generate desirable inner pressure values within disrupter 11 for expulsion of the water. Also, front rupture disc 40 rupturing before the rear rupture disc 44 allows to avoid rarefaction effect air intake in disrupter 11 before the water is entirely expelled from barrel 20 by forcing all the water out before the combustion ends. The rarefaction effect is the air intake that results from the vacuum being created pursuant to the combustion of the propellant that consumes air. Once the combustion ends, the rarefaction effect will create an incoming air wave that could significantly counteract the water expulsion if water were still present. Although the entire disrupter operation occurs over mere milliseconds, the timing of the rupturing of discs 40, 44 is relevant nonetheless to avoid hampering the water jet expulsion. When calibrating the timing between the rupturing of front and rear rupture discs 40, 44, it is also necessary to take into account the operating pressure of the rear convergent-divergent nozzle 34, discussed above, to ensure that once the rear rupture disc 44 ruptures, this operating pressure is already reached within housing inner chamber 32 for optimizing the disrupter operation.

Balancing the momentums of the expelled water and combustion gas, to cancel the resultant recoil, can be accomplished, in addition to calibrating the mass of water and propellant being used, by calibrating the ratio $D_F/D_T$, that represents the ratio of the diameter $D_F$ of the front nozzle's outlet orifice 49 with respect to the diameter $D_T$ of the rear nozzle's throat 38. Modifying any one of $D_F$ or $D_T$ will indeed result in modification of the mass flow rate, or the speed, of the expulsed corresponding water or combustion gas. The modification of both diameters $D_F$ or $D_T$ however needs to be carefully controlled, since its affects the internal pressure values during combustion, which will have repercussions over the entire disrupter operation, from the acceleration of combustion gas in rear nozzle 34 to the expulsion of water through the front nozzle 24.

One surprising result that was found during field tests, is that the front nozzle ratio, i.e. the diameter of barrel inner channel 22 with respect to the diameter of outlet orifice 49, need not be superior to 1 (a front nozzle ratio of 1 means a straight, non-convergent nozzle). In other words, front nozzle 24 need not be convergent, to obtain acceptable or even optimal results. FIG. 9 is a graph showing the evolution of water flow velocity out of a disrupter front end over time at given respective water and propellant masses. FIG. 9 more particularly shows two curves 80, 81 of a representative existing prior art non-recoilless disrupter and two curves 82, 83 for the recoilless disrupter of the present invention, each having different front nozzle ratios. Curves 80, 82 represent a front nozzle ratio of 1, while curves 81, 83 represent a front nozzle ratio superior to 1 (that could be, for example, a nozzle ratio of 4). From the graph of FIG. 6, it can be seen that the average water flow velocity in prior art non recoilless disrupters is more influenced by the modification of the front nozzle ratio, especially at the initial stages of the water expulsion. With the existing gas-compensated recoilless disrupter of the present invention, it can be seen from curves 82, 83 that using a nozzle ratio equal to 1 is mostly advantageous for target penetration. (Target penetration is the water jet's capacity to penetrate through a given solid barrier and is essentially the product of average flow velocity over time.) During the field tests, it was consequently found that modifying the nozzle diameter 49, even towards a nozzle ratio of 1, could be used to fine-tune the recoil balance either without significant reduction in target penetration or even with an increase in target penetration. This was unexpectedly advantageous as noted above, is unique to the gas-compensated liquid disrupter of the present invention and provides flexibility in the disrupter's fine-tuning to achieve recoilless status. This can be achieved by calibrating the $D_F/D_T$ ratio wherein the front nozzle may be convergent, or not, as long as the throat diameter 38 is controlled to balance the liquid and gas momentums. This is a very concrete advantage of the liquid/gas disrupter of the present invention compared to, say, liquid/liquid prior art disrupters where calibration of the front and rear nozzle ratios works much differently.

Use of a convergent-divergent rear nozzle 34 is certainly interesting, but not mandatory. Convergent-divergent nozzle 34 (as opposed to a straight, or alternately a convergent, nozzle) has the advantage of increasing the velocity of the outputted combustion gas, thereby increasing its momentum. Since it is, ultimately, the momentum of the frontwardly expelled water that needs to be counteracted by the momentum of the rearwardly expelled gas, with the momentum being the product of mass and velocity, the speed of the exhausted combustion gas matters. And since it is desirable to have a high speed for the water being expelled at the front end, having a high speed for the exhausted combustion gas at the rear end is also desirable. A convergent-divergent nozzle consequently allows use of lower propellant mass since the velocity of the outputted combustion gas will be higher, per unit of propellant being used, as long as suitable pressure values exist in disrupter 11 during operation thereof.

FIG. 10 shows an alternate embodiment of the invention. The disrupter 100 of FIG. 10 is similar to that of FIGS. 1-4, except as noted hereinafter.

Disrupter 100 comprises a barrel 102 that defines front and rear ends 102*a*, 102*b* and that has a water inner chamber portion 103 and a propellant inner chamber portion 104. A propellant cartridge (not shown) will be inserted through the rear end 102*b* of barrel 102 into propellant inner chamber portion 104. The cartridge will include a piston (not shown, but located approximately at position 106 in FIG. 10) that is movable in barrel 102 and that separates and seals the water from the propellant. The cartridge will also include a rear rupture disc (not shown, but located at position 107 in FIG. 10).

A straight front nozzle 108 is provided at the barrel's front end. More specifically, front nozzle 108 has a straight inner channel 110 that has a constant diameter equal to that of the barrel's inner channel 112 (i.e. a nozzle ratio of 1). The front rupture disc 114 is installed between the barrel's front end and the front nozzle 108 as usual.

A rear nozzle 116 is releasably attached (e.g. screwed) onto the barrel's read end 102*b*. Rear nozzle 116 is a so-called plug nozzle that comprises a main body 118 and a plug 120. Outlet (not shown) are provided radially about plug 120 in-between spokes 122 that link plug 120 to main body 118. Plug nozzle technology is known and will not be detailed any further.

Other alternate front nozzle, barrel, propellant housing and rear nozzle configurations may also be used.

I claim:

1. A method of controlling recoil in a disrupter, comprising:

providing liquid in a liquid chamber of the disrupter, said liquid chamber having a front nozzle for expelling the liquid therethrough;

providing combustible propellant in a propellant chamber of the disrupter that communicates with the liquid chamber and that has a rear nozzle for expelling combustion gases therethrough;

providing a barrier between the liquid and the propellant to avoid admixing both; and igniting the propellant to generate expanding combustion gases that will expel the liquid out of the disrupter through said front nozzle in a first direction, either rupturing or propelling the barrier in the process, the combustion gases exhausting out of the disrupter at least partly through said rear nozzle in a second direction, with the first and second directions being at least partly opposite one another to control the recoil of the disrupter, wherein said front and rear nozzles are provided with respective front and rear frangible seals that will rupture upon a threshold pressure value being attained to respectively allow the liquid and the combustion gases to be expelled through said front and rear nozzles, and wherein the respective intrinsic resistances of said front and rear frangible seals are balanced with the respective expected pressures from the liquid and combustion gases after the propellant is ignited to allow the front frangible seal to rupture slightly before the rear frangible seal.

2. A method as defined in claim 1, wherein said barrier is a piston that will be propelled by the combustion gases through said liquid chamber to expel both the liquid and the piston out of said liquid chamber through said front nozzle.

3. A method as defined in claim 1, wherein the front nozzle has an inner diameter equal to that of said liquid chamber.

4. A method as defined in claim 1, wherein the inner diameter of said front nozzle converges in a direction away from said propellant chamber.

5. A method as defined in claim 1, wherein the disrupter is comprises of an elongated barrel having coextensive and aligned propellant and liquid chambers.

6. A method as defined in claim 1, wherein the liquid is water.

* * * * *